United States Patent [19]

Vangor

[11] 4,423,820

[45] Jan. 3, 1984

[54] TAMPER PROOF CLOSURE AND METHOD OF MANUFACTURING SAME

[75] Inventor: William Vangor, Fairfield, Conn.

[73] Assignee: KLM Company, Bridgeport, Conn.

[21] Appl. No.: 353,401

[22] Filed: Mar. 1, 1982

[51] Int. Cl.[3] ..... B65D 41/34

[52] U.S. Cl. ..... 215/252; 264/156

[58] Field of Search ..... 215/252; 264/156, 544, 264/553, 554

[56] References Cited

U.S. PATENT DOCUMENTS 4,153,174 5/1979 Keeler ..... 215/252

4,225,050 9/1980 Reinhart ..... 215/252

*Primary Examiner*—Donald F. Norton

*Attorney, Agent, or Firm*—Darby & Darby

[57] ABSTRACT

A thermo-formed container closure having a breakaway ring including at least inwardly extending tab on the ring for engaging a lug on the container to prevent the ring from rotating as the closure top is unthreaded in which an annular flange joining the breakaway ring to the closure skirt wall is cut, except at a plurality of retaining bridges, with each of the bridges being of generally trapezoid shape and having a minimum area where the flange is attached to the closure skirt wall and a maximum area at the breakaway ring portion, to enhance the breakaway action as the ring is prevented from rotating.

12 Claims, 8 Drawing Figures

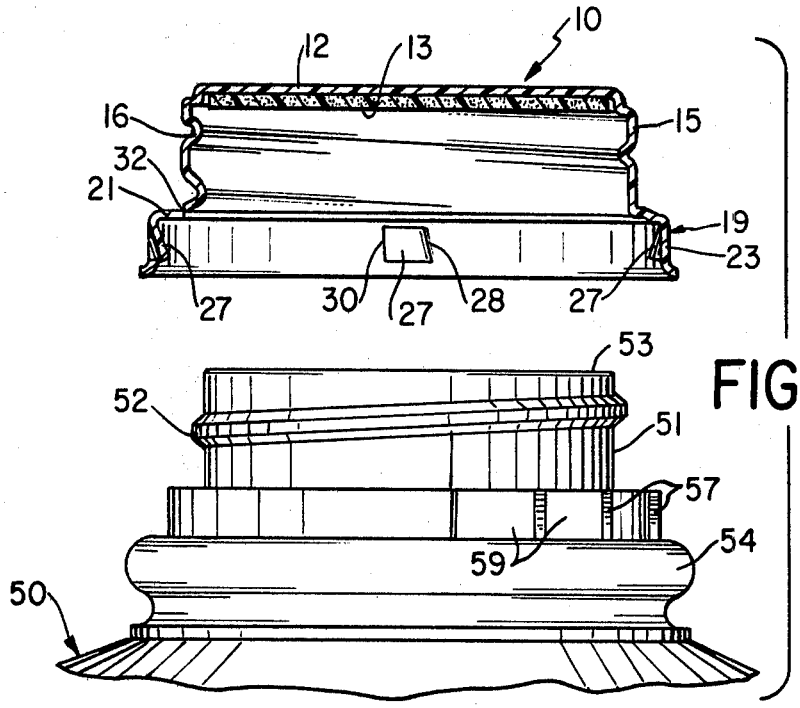
FIG. 1
FIG. 2
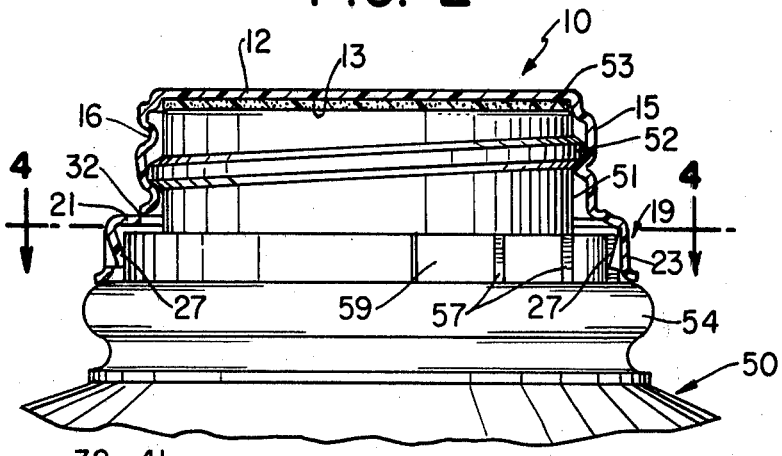
FIG. 7
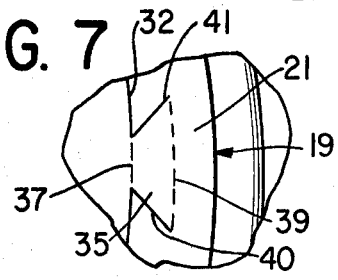
FIG. 8
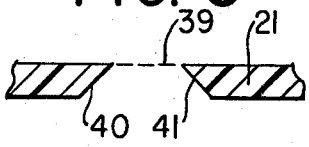

TAMPER PROOF CLOSURE AND METHOD OF MANUFACTURING SAME

Various types of container closures exist. Included among these are so-called safety, or tamper-proof, closures. One such safety closure is of the breakaway type and includes a top part which seals the container from which depends a skirt wall having an element, such as threads, for fastening the closure to the container. An arrangement is provided on the skirt wall so that when the closure is removed from the container, a part or an extension of the skirt wall will break away and drop over the container neck. The part broken away gives an indication that the container closure has once been opened.

Various types of closures of this type are known in the art. Included among these are U.S. Pat. No. 4,153,174, granted May 8, 1979 to Keeler and assigned to the assignee of this application. Another such closure is shown in U.S. Pat. No. 4,225,050 to Reinhart, granted Sept. 30, 1980. In both of the aforesaid patents, the closures are of the thermoformed type. That is, they are formed from sheet plastic material into the desired shape using a vacuum or pressure operated mold or die. The closure of each patent includes one or more locking means on the breakaway part for engaging a ratchet or lug on the container so that the breakaway part will not rotate as the closure is removed.

In the closure of U.S. Pat. No. 4,153,174, the arrangement for joining the breakaway part to the other part of the closure includes a series of interruptions leaving connecting or bridging portions. In the closure of U.S. Pat. No. 4,225,050, bridging portions are formed as predetermined segmented cuts of a circle on a horizontal shoulder which substantially surrounds the main cap body. The segments are cut to provide narrow bridges extending in the direction of counter-rotation of the closure. The ends of the bridges which connect the breakaway part to the closure are of the same width and the sides are generally parallel and extend in the direction of rotation of the closure as it is rotated to be unthreaded. The bridges are weak and flexible and they will bow upwardly and will break as the closure is unfastened with the breakaway part locking onto the container. This arrangement has some disadvantages in that the breaking action is not totally assured due to the structure of the bridges.

The present invention relates to an improvement in closures of the type of the aforesaid patents. Accordingly, the closures are of the thermoformed type, and include a top and a main part of the skirt wall having threads for fastening to the container. An annular flange or shoulder is attached to the skirt and this flange is lanced or cut through to leave a plurality of retaining bridges. A breakaway ring is attached to the flange by the bridges.

Each of the retaining bridges is generally trapezoidal in shape and each has an end of minimum area at the part of the flange closest to the main skirt wall and an end of increased area at the breakaway part. The sides of the bridges extend in opposite directions with the one side nearest to the direction of unthreading of the closure extending in the same direction. By using this arrangement, when the breakaway part is locked against further rotation as the closure is being removed, th bridges provide a maximum amount of connecting area for the breakaway ring, but a lesser amount of force is needed to break the connection when turning the closure while unfastening it. Also, a more positive breakaway action is achieved.

It is therefore an object of the present invention to provide an improved closure of the thermoformed type with a breakaway part.

A further object is to provide an improved breakaway thermoformed closure in which the portions joining the breakaway part to the main body of the closure are formed to facilitate the breakaway.

An additional object is to provide a thermoformed container closure in which connecting bridge for the breakaway part are formed of a generally triangular, or trapezoidal, shape with the apex, or narrower side of the bridge being at the portion of the closure closest to the main body.

Other objects and advantages of the present invention will become more apparent upon reference to the following specification and annexed drawings in which:

FIG. 1 is an elevational, exploded perspective view, partly in section, of a closure according to the present invention and a container to which closure is to be fastened;

FIG. 2 is an elevational view, partly is section, of the closure as fastened to a container;

Figure 3:
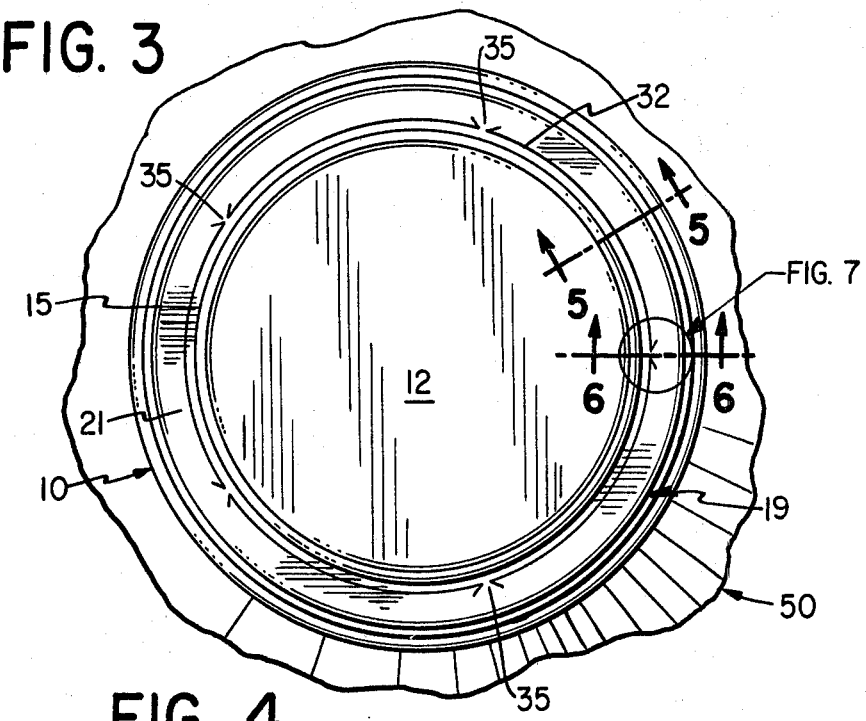
FIG. 3 is a top view of the combination of FIG. 2.
Figure 4:
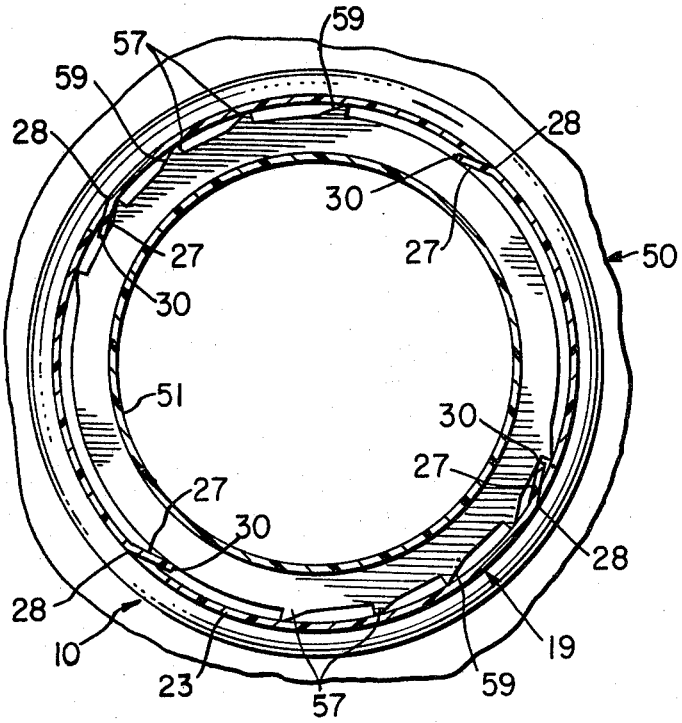
FIG. 4 is a cross-sectional view of the closure and container along lines 4—4 of FIG. 1.
Figure 5:
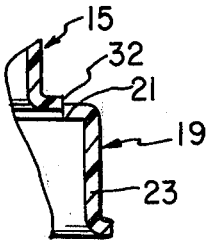
Figure 6:
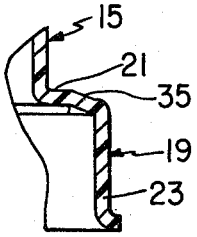

FIGS. 5 and 6 are segments of the closure in cross-section along lines 5—5 and 6—6 of FIG. 3;

FIG. 7 is an enlarged top plan view of a part of the closure having the bridge; and FIG. 8 is an elevational view showing the cut of the bridge.

FIGS. 1 and 2 show a preferred form of closure 10 utilized in the present invention. The closure is preferably made by thermoforming from a sheet of plastic material of substantially uniform thickness by drawing the sheet over a male mold or into a female mold. The closure formed is of relatively thin plastic material so that is has substantial flexibility, or resiliency, in all directions. Materials for forming the closure are any suitable plastic material such as, for example, polystyrene, polyethylene, polypropylene, ABS, etc. One suitable material is a medium impact 50—50 styrene plastic having a thickness of about 0.04 inches. The uniformity of the thickness of the closure sheet material is maintained except at those areas where the closure is deformed.

The closure 10 includes a top wall 12 and a downwardly depending skirt wall 15 formed with a plurality of threads 16. A liner 13 is held against the top wall by an adhesive or a friction fit. The linear is optional and can be, for example, of cellular foam material. Threads 16 are to mate with corresponding threads on the container. While continuous threads are shown, it should be understood that the invention is equally applicable to a closure and a container in which interrupted threads are used or one which uses a bayonet thread fastening arrangement.

Closure 10 is also formed with an extension, or breakaway ring 19, at the bottom of the skirt wall 15. The breakaway ring is of slightly greater diameter than the top portion of the skirt wall 15 and includes an outwardly extending shoulder, or flange, 21 which is joined to the skirt wall 15 and a downwardly extending vertical wall 23.

One or more locking tabs 27 are formed in the wall 23 of the breakaway ring 19 by cutting, piercing or lancing the wall at the appropriate place or places. The tabs are shown as being generally rectangular, although other shapes can be used, and are hinged about a line 28 which is generally vertical. The free end 30 of each tab extends radially inwardly of the closure in a generally counter-clockwise direction relative to the ring 19.

In FIG. 1, the locking tabs 27 are made by cutting the wall 23 on three sides, at the top, bottom and on one side of the tab. It is also possible to form the tabs by making only two cuts, for example, at the top and one side, and bending the corner so formed inwardly. This provides increased strength for the tabs, and an increased ability to lock the closure when it is unthreaded.

FIGS. 2, 3, 5, 6, 7 and 8 show in enlarged detail the flange 21 of the breakaway ring 19. The flange is lanced, or cut, in a line 32 almost entirely around its circumference close to the bottom of skirt wall 15 leaving only a plurality, five being shown in the preferred embodiment, of bridges 35. These bridges are generally V or trapezoidal shaped in nature with the narrowest part 37 of the bridge pointing toward the skirt wall 15, and the widest part, or base, 39 facing toward the breakaway ring. The narrow part 37 of the bridge is not a point but is, instead, a widened finite area. The two sides 40, 41 of each bridge angle away from the narrow part 37 and each forms an acute angle with the cut line 32. The angle between the two sides 40, 41 can be, for example, about 120°. The respective sides 40, 41 extend from the narrow part 37 of the bridge in the direction of rotation of the closure with respect to that side. That is, assuming the closure to be threaded onto the container is a clockwise direction, the side 40 opens outward from the narrow part 37 in that direction. Similarly, the side 41 opens outwardly in the counter-clockwise direction of unfastening of the closure.

In cutting the flange 21 to form the bridges 35, a ring-shaped die is used which fits over the closure top and skirt wall 15 and contacts the flange at the cut line 32. The horizontal plane of the die is formed to obtain the bridges shaped as previously described. Also, the die is generally V-shaped in the vertical direction so that the bridges have a varying area through their thickness and have more material at the bottom of th flange 21 than at the top of the flange. This is shown in FIG. 8.

FIGS. 1–2 also show a container 50 with which the closure of the subject invention is to be utilized. The container is glass, plastic or other suitable material and is formed by any conventional technique corresponding to the material, for example, by blowing, molding, blow-molding, etc. The container includes a neck 51 having threads 52 thereon below a sealing lip 53. A transfer ring 54, used during manufacturing for transferring the container, is formed below the threads.

A plurality of locking lugs 57 are formed between the transfer ring 54 and the thread 52. The lugs can be of any suitable number depending upon how far the closure is to rotate before breakaway of the ring is to be obtained. The lugs are wedge shaped, or tapered, from a thinner part to a thicker part in the clock-wise direction (right to left as shown in the drawing) so that each lug has a vertical wall 58 for engaging the free edge 30 of the closure tab 27 and a sloping wall 59 over which the tab can ride.

In operation, the closure 10 is threaded onto the container neck 51 in a clock-wise direction. As it rotates in the closk-wise direction, the tabs 27 ride over the sloping walls 59 of the locking lugs. As noted previously, the closure material is flexible and the lugs therefore flex. The threading is continued until the liner 13 firmly engages the container sealing lip 53.

When the closure is unthreaded, by rotating it counter-clockwise, the inwardly extending free edge 30 of the locking tab, or tabs, engages a wall 59 of a locking lug 57. At this time, the closure is temporarily locked from further rotation. Continued counter-clockwise rotation causes the bridges 35 to bow upwardly. Due to the angled cut of the bridges in the vertical direction (see FIG. 8), there is more material at the lower part of the flange 21. This arrangement retards the bowing action to a slight degree since the wider part of the bridge at the bottom of the flange wedges into the narrower part closer to the top resulting in more force being needed to produce the bowing action.

At about the same time or shortly after the upward bowing, the material of the bridges will fracture and tear. The fracture will generally occur at the narrow part of the bridge closer to the skirt wall. The reliability of the fracture is increased by the configuration of the bridge and especially the presence of the acute angle formed between the side cut 41 of the bridge and the cut line 32. Due to the fact that the part of the bridge facing toward the breakaway ring is wider, the holding force is maximum at the ring and the breakaway action is made more positive at the narrow part 37 of the bridge facing the skirt wall.

What is claimed is:

1. A closure thermoformed from a sheet of plastic material to have a top, a skirt wall having one end depending from said top, an annular, generally horizontal flange having one edge attached to the other end of said skirt wall, a breakaway ring depending downwardly from said other edge of said flange, said flange being cut therearound to form a major cut line through the flange and a plurality of bridges which hold the ring to the flange, each of said bridges being generally trapezoidal in shape with two generally parallel sides, one being narrower than the other and two ends joining said sides with the ends diverging in generally opposite directions from said narrow side, the narrow side of each bridge facing and connected to the skirt wall and the other wider side facing and connected to the breakaway ring, and at least one tab on said breakaway ring adapted to engage a lug on the container to which the closure is fastened when the closure is unfastened by rotation in a first direction, the continuing rotation of the closure in said first direction causing the ring to lock and the bridges to fracture whereby the breakaway ring separates from the closure.

2. A closure as in claim 1 wherein the ends of said bridges are cut at an angle through the thickness of said flange such that there is more material for the bridge at the lower surface of said flange than at the upper surface.

3. A closure as in claim 2 wherein the angled cuts of the ends of the bridge through the flange is generally straight.

4. A closure as in claim 2 wherein the ends of each bridge extend to and make substantially equal angles with the major cut line of the flange, but are of opposite direction relative the skirt wall.

5. A closure as in claim 4 wherein each end of a bridge intersects the major cut line of the flange at an acute angle.

6. A closure as in claim 1 wherein the ends of each bridge extend to and make substantially equal angles with the major cut line of the flange, but of opposite direction relative to the skirt wall.

7. A closure as in claim 6 wherein each end of a bridge intersects the major cut line of the flange at an acute angle.

8. A closure as in claim 1 where a said tab is cut on at least two joining edges and is formed to extend inwardly of said breakaway ring.

9. A closure as in claim 8 when said tab is cut at only two joining edges to form a corner for engaging a lug on the container.

10. A closure as in claim 1 further comprising means on said skirt wall adapted for fastening the closure to mating means of a container.

11. A method for forming a safety closure comprising the steps of thermo-forming the closure from a sheet of plastic material to have a top, a skirt wall depending downwardly from said top, an annular flange extending outwardly from the lower end of said skirt wall and a breakaway ring extending downwardly from said flange, forming at least one radially inwardly extending tab on said breakaway ring for engaging a projection on the container to prevent rotation of the ring as the closure is being unfastened, and cutting said flange therearound to form a plurality of bridges of generally trapezoidal shape having two generally parallel sides with one being narrower than the other and two ends joining said sides with the ends diverging in generally opposite directions from said narrow side, with the narrow side of the trapezoid facing toward and connected to said skirt wall and the wider side facing and connected to said ring.

12. The method of claim 11 wherein the step of cutting the bridges further comprises making the cuts for the ends of the bridge at an angle such that the bridge has a decreasing amount of material from the top to the bottom of the flange.

* * * * *